United States Patent [19]

Wright

[11] 4,017,071

[45] Apr. 12, 1977

[54] MACRAME SWING AND METHOD OF FORMING

[76] Inventor: Jim Wright, Rte. 3, Box 348, Rockingham, N.C. 28379

[22] Filed: Feb. 23, 1976

[21] Appl. No.: 660,106

[52] U.S. Cl. ..... 272/85

[51] Int. Cl.[2] ..... A63G 9/00

[58] Field of Search ..... 272/85–92; 29/91; 294/77; 248/273, 341

[56] References Cited

UNITED STATES PATENTS

| | | | |
|---|---|---|---|
| 2,291,721 | 8/1942 | Hutaff, Jr. | 272/85 |
| 3,827,745 | 8/1974 | Pugh | 294/77 |
| 3,937,463 | 2/1976 | Soisson | 272/85 |

*Primary Examiner*—William H. Grieb

[57] ABSTRACT

An upper support ring is suspended from a stationary support by a plurality of spaced groups of cords, and a plurality of macrame straps suspend a seat portion from the upper support ring. A plurality of rows of macrame knots extend around and between the upper ends of the straps to form a decorative canopy. All materials and instructions necessary for construction of the swing may be provided in kit form, so that it may be hand-crafted by the consumer.

5 Claims, 5 Drawing Figures

MACRAME SWING AND METHOD OF FORMING

BACKGROUND OF THE INVENTION

Swings have long been a source of amusement and in the prior art many varieties can be found. They may be operated manually or by a separate power source and they may be constructed from a variety of materials including metal, plastics, or natural fibers.

The large number of swings are primarily designed for amusement and relaxation, both for children and adults. Swings are found on patios, porches, in yards or other such areas. Additionally, there are many known amusement park rides which feature swing devices.

The only prior art known to the applicant to be even vaguely similar to the present invention is U.S. Pat. No. 3,827,745 to Billy G. Pugh for a personnel or cargo net. This patent discloses a cushioned base or load supporting platform, a series of vertical cords extending between the load supporting platform and a pick-up ring, and an upper spreader ring which holds the upper portions of the cords apart. It is used for hoisting cargo or personnel by crane from ship to ship or ship to platform. The webbed sidewalls form a net extending substantially around the load supporting base to protect cargo or personnel from falling.

The present invention is directed to a decorative macrame swing which, in a preferred embodiment, includes a plurality of knotted lengths of hemp or jute rope. Constructed to be suspended from a stationary support, the swing includes a canopy and support straps formed of macrame knots and extending between the support ring and a padded seat which will accommodate at least one person. The canopy and side straps are looped around the upper support ring which itself functions to support and form the main body of the swing and as a spreader ring to provide headroom for the occupant.

The materials required to construct the swing may be prepackaged for handcrafting by a consumer at a cost considerably less than that required for purchase of the finished swing. The availability of the swing in kit form will appeal to those individuals who enjoy the art of macrame as a relaxing hobby. In the preferred embodiment, the swing is constructed of natural hemp or jute fiber ropes so that its finished state will also appeal to those individuals who are interested in a return to increased use of natural products in the decor of their homes. The hemp or jute is a natural complement to the plants and greenery found on patios, in Florida rooms or other like places where such a swing would generally be used.

The objects of the invention will become apparent from the following detailed description when studied in conjunction with the accompanying drawings, in which.

DETAILED DESCRIPTION

Figure 1:
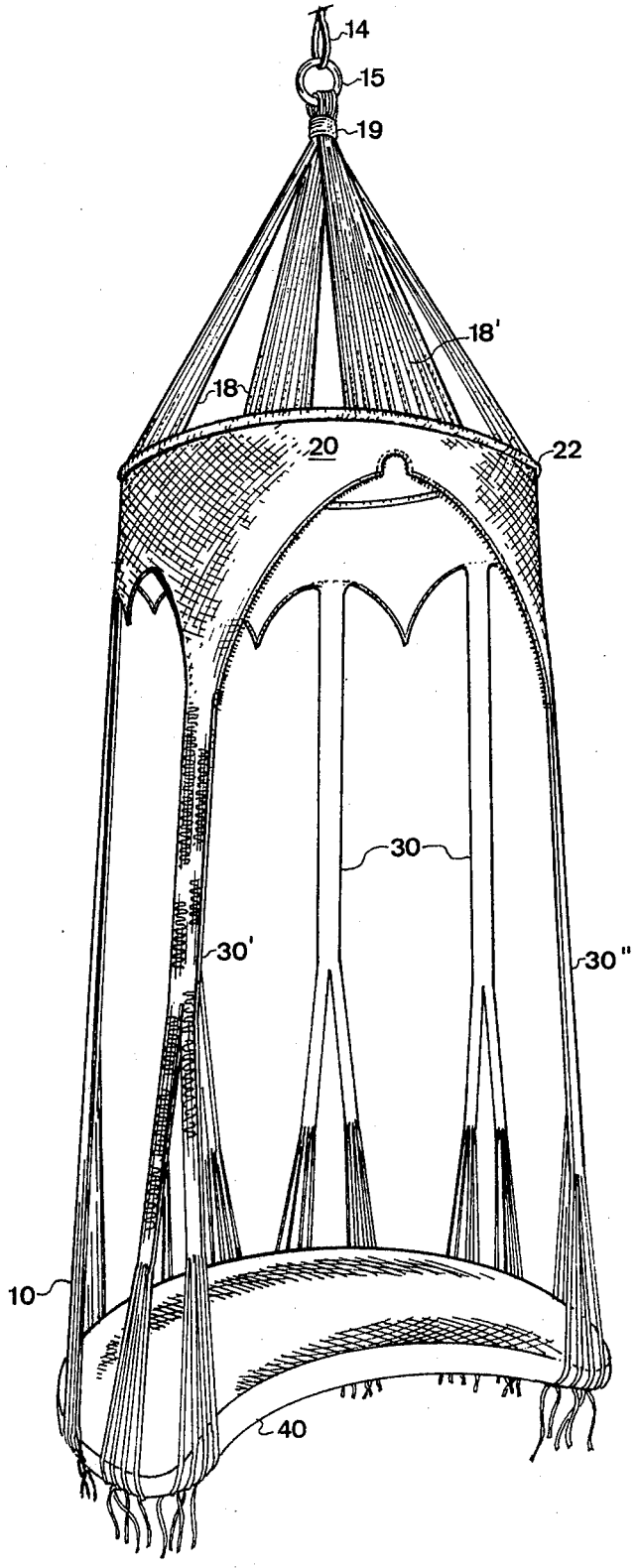
FIG. 1 is a perspective view of the swing according to the present invention looking at the front side thereof.

A preferred embodiment of the macrame swing according to the present invention is illustrated in FIG. 1 with the swing apparatus 10 suspended from a stationary support by a small eyelet 15 and rope or chain 14. The primary decorative and functional components of the swing 10 include a plurality of spaced groups 18 of cords, an upper support ring 22, a macrame canopy portion 20, and a plurality of macrame straps 30 extending from separate sets of cords to improve the levelling and functioning of the swing. All cords are hemp or jute ropes and knotted according to the art known as "macrame" which is that of producing a coarse lace or decorative surface by knotting threads or cords in a geometrical pattern.

The canopy includes a plurality of cords of variable lengths looped around the support ring 22 and extending downwardly. The cords are attached to ring 22 in side by side relationship completely covering and obscuring the metallic ring itself. A first set of the downwardly extending cords are extension of the cords in groups 18, while a second, separate set of the cords (six groups) form the straps 30.

Figure 4:
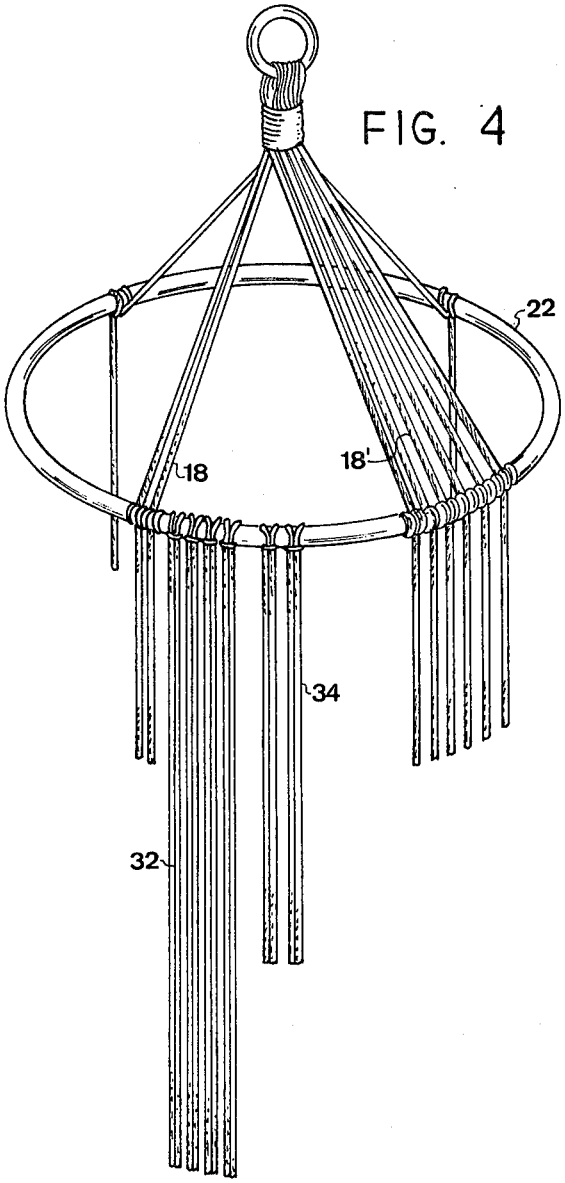
FIG. 4 is a partial perspective view, similar to FIG. 3, except illustrative of a second intermediate stage of construction.
Figure 2:
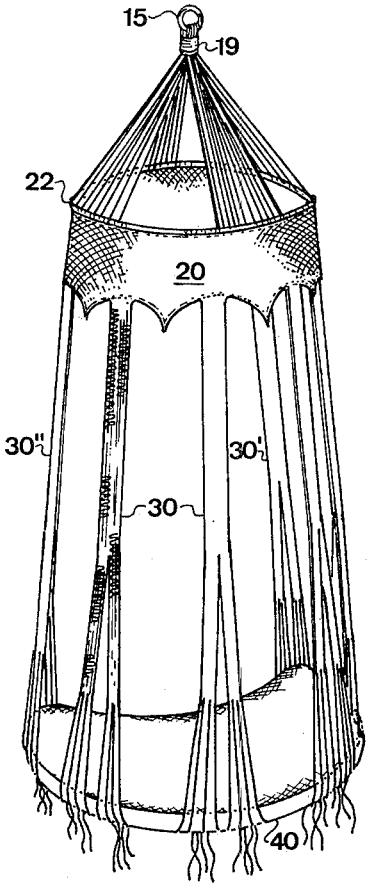
FIG. 2 is a perspective view, similar to FIG. 1, except looking at the rear side thereof.
Figure 3:
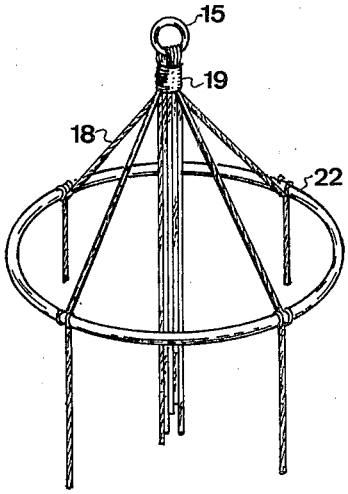
FIG. 3 is a partial perspective view, looking at the front side again, during a first intermediate stage of construction.

Detailed views of the swing during intermediate stages of construction are provided in FIGS. 3 and 4. Generally, the construction is according to the following instructions which are those that produce a finished swing as illustrated in FIGS. 1 and 2. It should be understood that these illustrations are exemplary of a preferred embodiment and many variations are possible.

Initially, a first prescribed plurality or set of cords are cut to a designated length to provide a means for suspending ring 22 and begin formation of canopy 20. In the present instance, approximately 24 cords, each 12 feet long, are slipped through an eyelet means 15 to approximately half of the cords' length and form a means for suspending the swing from a stationary support. Around this first set of cords, just below suspension means or eyelet 15, a separate cord length 19 is wrapped and tied immediately beneath eyelet means 15 to securely hold the cords together. The cord lengths are then divided into four groups 18,18' equally spaced around support ring 22 as illustrated in FIG. 3, thereby functioning as a means for suspending the ring 22, and thus the entire swing therefrom. The ring 22 is then in position to serve as abase onto which the canopy 20 and the straps 30 are constructed. Obviously, without this support ring 22, the canopy 20 would collapse radially and, although the swing might still be made to function, there would be very little headroom for the occupant and much of the decorative effect would be lost.

Each cord groups 18,18' is attached to the support ring 22 by means of double half-hitches at a point intermediate the length thereof. It should be noted that, after cord groups 18 are hitched to the ring 22, a portion of each cord extends downwardly to later form an arcuate portion of canopy 20. Alternately, additional cords may be interlaced into these groups 18 for a more decorative effect.

The construction of the canopy 20 first involves cutting a second set of approximately 24 cords 32 (FIG. 4) in lengths of 28 feet. These cords 32 are doubled and four doubled cords are attached to the ring 22 on either side of three of the cord groups 18 previously tied to the ring. The arcuate area of support ring 22 adjacent the fourth cord group 18', where no cords 32 are placed, will become the front of the swing. The open space remaining between the two forwardmost straps 30'30'' at each front corner of the seat should be approximately 16 inches, or a distance sufficient to allow easy passage of a person of ordinary size. The longer cords 32, when looped and hitched to support ring 22, become the cords which later will be tied and laced to form straps 30.

Figure 5:
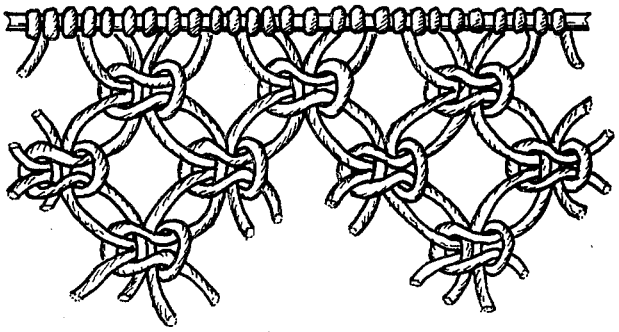
FIG. 5 is a knot diagram illustrating the formation of the decorative canopy.

Continuing with emplacement of cord lengths on ring 22, a third set of 28 additional shorter cords 34 (FIG. 4) are cut in appropriate lengths, doubled and attached to ring 22 on either side of the fourth cord group 18'. These cords 34 will later be formed into the front portion of canopy 20. In the preferred embodiment, 20 additional short cords are cut and attached to ring 22 in the empty spaces around the rear of ring 22. Using conventional macrame techniques, all cords depending from ring 22 are knotted from support ring 60 down to a depth of approximately 6 to 9 inches with the exception of the front portion of canopy 20, which is formed as illustrated in FIGS. 1 and 5. Subsequently the long cords 32 below the canopy 20 which were earlier formed into six groups are laced and knotted to complete formation of the six supporting straps 30.

At this point the cords 32 which form straps 30 may be secured to seat member 40 by any of several known methods. According to the preferred embodiment, seat member 40 is cut into the desired shape from a sheet of five-eighths inch plywood, over which is placed a sheet of 1½ inches foam rubber material. The plywood and the foam rubber are then covered with a selected decorative material such as upholstery leather, imitation leather, or any of the known durable upholstery fabrics. The seat 40 may then be suspended from straps 30 by stapling the ends of the cord 32 to the underside of the seat, or by inserting ends of the cords through holes in the seat and knotting the cords on the underside.

The finished swing is illustrated in FIG. 1 in a design which may be supplied in a finished, ready to use state or in kit form. Many people are currently interested in a return to the practice of such arts as pottery, many forms of needlework, and various other crafts requiring the use of the hands. For this reason, all the components required for construction of the present invention can be packaged in a kit which would include an eyelet 15, an upper support ring 22, a seat 40, and a length of hemp or jute at least as great as the combined total of all lengths enumerated hereinabove. A person may then take these components and personally handcraft the swing. Therefore, not only is the finished swing a useful object as a home furnishing, but the kit is in itself a means of practicing a relaxing, satisfying art. Additionally purchase of the kit would be more economical than purchase of the finished swing.

Although the present invention has been described in detail for purposes of illustration, it should be understood that further embodiments may be utilized by those skilled in the art without departing from the scope of the invention which is limited only by the following claims:

What is claimed is:

1. A swing apparatus of the type adapted to carry a human occupant suspended above the ground or floor from a stationary elevated support comprising:

a. an upper support ring and a generally planar, lower seat member spaced from said support ring and having front, rear, and side edges;

b. a plurality of spaced straps connecting spaced points on said ring with spaced points around the sides and rear edges of said seat member, each of said straps being formed of a plurality of cord lengths knotted together according to conventional macrame techniques;

c. the front edge of said seat being void of any straps extending between said front edge and said ring, said ring front edge having a length of at least 16 inches to accommodate a normal occupant; and d. means connecting said support ring and stationary support for suspending said support ring from said stationary support.

2. The swing apparatus according to claim 1 wherein said means for suspending said support ring comprises an eyelet and a plurality of cord groups connecting said eyelet and spaced points around said supporting ring.

3. The swing apparatus according to claim 2 wherein one of said spaced straps is attached to said support ring at a position on each side of all but one of said cord groups.

4. The swing apparatus according to claim 1 wherein a decorative canopy depends from said support ring between said spaced straps.

5. Method of fabricating a decorative macrame swing comprising the steps of:

a. selecting an eyelet, seat member and upper support ring;

b. cutting a first set of cords to a prescribed length, folding said cords in half and draping them through said eyelet so that the ends of said first set of cords are substantially even;

c. dividing said first set of cords into four cord groups, and using half-hitches, tying the intermediate portion of said cord groups to form evenly spaced positions around said support ring;

d. cutting a second set of cords to a second, longer length, folding in half and attaching a prescribed number of said second sets of cords by the mid-section thereof to said support ring one either side of three of said four cord groups formed in step (c) to form six straps with the cord ends thereof hanging down;

e. cutting a third set of cords to a third, shorter length, folding in half and attaching said third sets of cords by the mid-section thereof to said support ring on eithe side either the fourth cord group formed in step (c) so that the ends thereof hang down;

f. forming a decorative canopy by tying successive rows of conventional macrame knots around the depending first, second, and third sets of cords;

g. completing said straps by knotting the cords in each of said six straps together along at least a portion of the length thereof; and h. attaching the lower ends of each strap to said seat member.

* * * * *